US006511259B1

(12) United States Patent
Khieu et al.

(10) Patent No.: US 6,511,259 B1
(45) Date of Patent: Jan. 28, 2003

(54) PARTICLE DISPENSER WITH FLUID ASSIST TO CONTROL PARTICLE VELOCITY FOR USE ON A MOVING VEHICLE

(75) Inventors: Sithya S. Khieu, Eden Prairie, MN (US); Mark D. Zender, Mahtomedi, MN (US); David C. May, Hudson, WI (US); John L. Marty, White Bear Lake, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/459,505

(22) Filed: Dec. 13, 1999

(51) Int. Cl.[7] ..... E01C 17/00; E01C 7/35
(52) U.S. Cl. ..... 404/101; 404/14; 239/455
(58) Field of Search ..... 404/14, 16, 22; 239/150, 533.15, 546, 602, 455, 146, 290, 301, 151

(56) References Cited

U.S. PATENT DOCUMENTS

| | | | | |
|---|---|---|---|---|
| 3,292,507 | A | 12/1966 | Vanstrum | 94/1.5 |
| 4,069,281 | A | 1/1978 | Eigenmann | 264/1 |
| 4,319,717 | A | 3/1982 | Hofmann | |
| 4,388,359 | A | 6/1983 | Ethen et al. | 428/143 |
| 4,462,547 | A | 7/1984 | Metz | |
| 4,518,121 | A | 5/1985 | Smith | |
| 4,875,798 | A | 10/1989 | May | 404/12 |
| 5,169,262 | A | 12/1992 | Wilson et al. | 404/84.05 |
| 5,203,923 | A | 4/1993 | Hartman | |
| 5,294,798 | A | 3/1994 | Hartman | |
| 5,417,515 | A | 5/1995 | Hachey et al. | 404/15 |
| 5,731,369 | A | 3/1998 | Mahoney | |
| 5,747,626 | A | 5/1998 | Krepski et al. | |
| 5,774,265 | A | 6/1998 | Mathers et al. | |
| 5,835,271 | A | 11/1998 | Stump et al. | |
| 5,853,851 | A | 12/1998 | Morris | |
| 5,897,914 | A | 4/1999 | DePriest | |
| 5,917,652 | A | 6/1999 | Mathers et al. | |

FOREIGN PATENT DOCUMENTS

| | | | |
|---|---|---|---|
| EP | 0 560 719 A1 | 9/1993 | E01C/23/16 |
| WO | WO 96/34151 | 10/1996 | E01C/23/16 |

OTHER PUBLICATIONS

MRL Equipment Company Brochure entitled "Truck Mounted Thermoplastic Stripers".
MRL Equipment Company Brochure entitled "Thermoplastic 'Convertible' Spray/Extrude Gun".
One page of copies of 3 photographs.
MRL Equipment Company Brochure entitled "Thermoplastic Hand Liner".

*Primary Examiner*—Thomas B. Will
*Assistant Examiner*—Raymond W. Addie
(74) *Attorney, Agent, or Firm*—James V. Lilly

(57) ABSTRACT

When mounted to a vehicle, a dispenser ejects optical elements so that they have a component of movement that is parallel with the surface of the pavement to which the optical elements are to be applied. Preferably, the component of movement in that direction is more significant than a component of movement directly toward the pavement surface. A fluid assist causes the optical elements to be ejected from the dispenser nozzle at a velocity to at least partially counteract, and preferably match, the forward velocity of movement of the vehicle to which the dispenser is attached. Thus, in accordance with one specific aspect of the present invention, optical elements can be laid down upon marking material that has been applied to a pavement surface at a substantially reduced relative velocity to the road surface. By more closely matching the optical element velocity in a direction opposite the vehicle movement to the velocity of the vehicle, the optical elements can be laid down without substantial roll along the pavement marking material. This can be accomplished regardless of the size or mass of the optical elements. The result is that the retroreflectivity of the pavement marking is thus not compromised or negatively affected in either direction (i.e. in the direction of vehicle travel or in the opposite direction).

43 Claims, 6 Drawing Sheets

PARTICLE DISPENSER WITH FLUID ASSIST TO CONTROL PARTICLE VELOCITY FOR USE ON A MOVING VEHICLE

TECHNICAL FIELD

The present invention relates to dispensing devices and systems that are used for dispensing and applying particles or granulated material onto the surface of a substrate while the dispenser is moved relative to the substrate. In particular, the present invention relates to particle dispensers to be mounted to a vehicle so that during movement of the vehicle particles can be dispensed through the dispenser nozzle onto the surface of road pavement, such as to enhance pavement markings with retroreflective particles.

BACKGROUND OF THE INVENTION

Pavement marking or striping is typically conducted by applying paints, resins, tapes or the like to the road surface by relative movement of a vehicle with respect to the road surface. That is, markings or stripes are applied over a pavement surface in the direction of movement of such a vehicle. Typical paint or resin application systems comprise spray devices, other contact painting devices, such as rollers or brushes or resin extruders. Tapes are typically provided by unwinding tape from a source roll and applying it to the pavement by way of an application roller. In any case, paint, resin or tape is to be supplied to the dispensing point and applied to the pavement surface in a controlled manner so that the proper amount of paint, resin or tape is provided based upon the demands of usage and required coverage.

In addition to any of the above materials utilized for providing markings or stripes, pavement markings now widely use reflective particles as well. Such paints, resins (e.g. thermoplastics or epoxies) and tapes may contain reflective particles, such as transparent microspheres within their composition. Preferably, the resultant pavement markings are retroreflective so that motor vehicle drivers can vividly see the markings at nighttime. Retroreflective pavement markings have the ability to return a substantial portion of incident light toward the source from which the light originated. Light from motor vehicle headlamps is returned toward the vehicle to illuminate road features, e.g., the boundaries of the traffic lanes, for the motor vehicle driver.

More recent development of optical elements for retroreflective pavement markings are directed to optical elements with greater retroreflectivity at low angles of incidence. Transparent optical elements, such as glass beads, on the one hand each act as a spherical lens so that incident light can be reflected back to the motorist after it passes through an optical element and strikes pigment particles within the marking material. An example of a specialized glass microsphere is described in U.S. Pat. No. 5,853,851.

To reflect more incident light back to the motorist for improved marking visibility, reflective vertical surfaces are being incorporated into pavement markings. For example, raised pavement markers may be provided at intervals along a pavement marking line, such as disclosed in U.S. Pat. Nos. 3,292,507 and 4,875,798. Another example is the use of embossed pavement marking tapes such as disclosed in U.S. Pat. Nos. 4,388,359, 4,069,281, and 5,417,515. Yet other examples comprise the provision of composite retroreflective elements or aggregates that typically include a core material with any number of optical elements embedded to the core surface. Such composite elements may be irregular in shape or may be shaped into spheres, tetrahedrons, discs, square tiles, etc. Such composite retroreflective elements are advantageous because they can be embedded into inexpensive paints and resins. Such composite retroreflective elements are known to comprise polymeric and/or ceramic core compositions. An example of durable retroreflective elements comprising a ceramic core can be found in U.S. Pat. No. 5,774,265. A retroreflective element comprising a multi-sided retroreflector and a clear thermoplastic resin is described in U.S. Pat. No. 5,835,271. Each of the above-noted U.S. patents is fully incorporated herein by reference.

Whether or not the retroreflective optical elements utilized in a pavement markings comprise conventional glass beads or composite optical particles, such optical elements can be incorporated into the pavement marking either as part of the composition of the material that is applied as the pavement marking or they may be dispensed onto the pavement marking material after it is applied but while it is capable of permitting particles to at least partially embed therein, i.e. while the marking material is still sufficiently tacky, wet or soft. In the case of a tape, the optical elements are typically formed into the tape during the tape-making process. But, with paints and resins, optical elements can be mixed into the paint or resin before application, mixed with the paint or resin just prior to application, or dispensed onto the pavement marking material after it has been applied to the pavement surface. Of these, the latter technique is generally preferred because the optical elements are assured of being present at the surface of the pavement marking where their retroreflectivity is functional. Particles within the thickness of the marking may be subsequently utilized after the pavement marking wears down. Also, optical elements dispersed within a paint or resin before or during application may not be retroreflective at all, depending on the transmissivity of the paint or resin, and on whether the entire element is coated with that paint or resin.

Examples of pavement marking painting and bead dispensing systems are described in U.S. Pat. Nos. 4,319,717, 4,518,121, 5,203,923, and 5,294,798. In each of these, the bead dispenser is located on a movable vehicle that also carries the paint or resin applicator, so that an appropriate quantity of beads are dispensed onto the width of the marking in accordance with predetermined marking characteristics. Of these, the device disclosed in U.S. Pat. No. 4,518,121 is directed to a bead dispenser whereby optical beads are deflected into the paint spray so that paint and beads are deposited together on a pavement surface to form a reflective stripe. The others are directed to bead dispensers that apply the beads to the marking paint or resin after it is applied to the pavement surface while still sufficiently wet. Moreover, in these bead applicators that spray beads onto the marking material, the beads are directed from a dispensing unit comprising a nozzle in a downward direction aimed toward the pavement. In U.S. Pat. No. 4,319,717, the disclosed spray gun includes an air nozzle for increasing the impact of the beads to the marking material than would be experienced under gravity alone. The dispensers described in U.S. Pat. Nos. 5,203,923 and 5,294, 798 are described as having the ability to dispense the tiny beads under air pressure through the dispensing valve. That is, the beads are supplied to the dispenser by virtue of a volume of air under pressure that not only moves the beads to the dispenser, but also causes the beads to be dispensed at a higher exit velocity than if simply dropped under the force of gravity.

Other dispensers, including nozzles oriented other than directly toward the pavement surface, are also known. For example, a dispensing nozzle connectable to a pressurized supply of beads is known that includes a plate for directing the beads in an opposite direction as the direction of movement of the vehicle utilized in applying the marking material and the glass beads.

A disadvantage of all of these prior art dispensers and nozzles is that the beads are dispensed onto the pavement marking material at a relative velocity compared to the pavement marking. Where the beads are dropped directly onto the pavement marking, the relative velocity equals the velocity at which the vehicle, whether manual or motor driven, is moving over the pavement. Where the dispensing nozzle faces in the opposite direction than the direction of movement, the relative velocity can be reduced. This depends on whether the beads exit the nozzle with any component of movement in a direction opposite to the direction of travel. This oppositely directed component of movement and thus the amount of reduction of the relative velocity are dependent in these prior art systems upon the pressure by which the glass beads are supplied to the dispensing nozzle.

As discovered in the development of the present invention, the relative velocity at which the optical elements strike the pavement marking material can cause the optical elements to roll along the pavement marking material in the direction of vehicle travel after initial striking. As the elements roll, they pick up some of the paint or resin onto their surface, which prevents that portion of the optical element from retroreflecting light. This phenomenon was discovered and can be quantified by directionally measuring the retroreflectivity of the pavement marking after the optical elements are applied. That is, by comparing the retroreflectivity attained in a direction of a pavement marking facing the direction of movement of the applying vehicle versus the direction from which the vehicle came, the effect of the rolling can be quantified. The greater the difference between the two measured readings, the greater the distance that the element is believed to have rolled, up to the point where the optical elements have rolled through 90 degrees. That is, a 90-degree roll of all of the optical elements would block retroreflectivity from one direction, while from the other direction, retroreflectivity would be substantially unimpaired. Where the two measurements are substantially equal, no significant rolling is believed to have occurred.

This rolling problem can be exacerbated when trying to apply the much larger optical particles, such as the composite retroreflective elements described above. These composite elements can be of many different sizes, but generally, all are significantly greater in volume and mass than typical glass beads, meaning that they each have more momentum when they are dispersed onto the marking material. Rolling of these composite particles within the pavement marking material, like the glass beads discussed above, causes the composite elements to pick up some of the marking material and can block some of its reflective surfaces. This could block the incident light to or through the core material of the composite element, or may shield the reflective nature of a reflective component at the surface of the composite element. Since these larger and more massive retroreflective elements (whether spherical or irregularly shaped) are more likely to roll under a given application condition than glass beads, these composite retroreflective elements may experience rolling and worsened retroreflectivity even where glass beads can be applied with little or no rolling problem.

In this industry, there is a continual desire to apply the pavement markings at greater speeds so as to reduce disruption to traffic conditions and to improve the application process. As can be understood from the above, greater speeds worsen the problem of particle rolling. Even in the case where a nozzle of a dispenser for the particles is directed away from the direction of travel of the vehicle, supplying the particles under pressure to reduce the relative velocity between the particles and the pavement is inadequate. Increasing the supply pressure of the particles to the nozzle in order to propel the particles from the nozzle at a greater velocity, and thus reduce the relative velocity between the particles and the pavement, does not provide satisfactory results because the increased pressure supply also results in an increase of the quantity of the particles supplied through the nozzle. This leads to an increased density of particles applied to a particular pavement marking, which may waste a significant quantity of such particles beyond that which is desired or functional. Regarding the functionality of such particles, it is noted that with the larger composite retroreflective particles, a maximum loading is usually discernable. That is, beyond a predetermined density of particle loading, more particles can actually have a deleterious effect. In particular, the particles may actually shadow one another, thus reducing the retroreflective functionality of the pavement marking.

SUMMARY OF THE PRESENT INVENTION

The present invention is based in part on the discovery of the above-described optical element rolling phenomenon and the recognition of the deficiencies in the prior art. Moreover, the present invention overcomes the disadvantages and shortcomings of the prior art devices for dispensing optical elements onto pavement marking material by providing a fluid-assisted particle dispenser and method for controlling the velocity that the optical elements exit the dispenser to thereby control the relative velocity at which the optical elements strike the pavement marking material when used on a moving vehicle. The fluid assist is advantageously introduced into the dispenser independently of the feed rate of optical elements through the dispenser. That is, the quantity of optical elements to be applied can be controlled independently of the velocity at which the optical elements are to exit the nozzle of the dispenser.

When mounted to a vehicle, a dispenser in accordance with the present invention ejects such optical elements so that they have a velocity component in the opposite direction of movement of the vehicle to which the dispenser is attached. Preferably, the fluid assist causes the optical elements to be ejected from the dispenser nozzle at a velocity to substantially match the forward velocity of the vehicle to which the dispenser is attached. Thus, in accordance with one specific aspect of the present invention, optical elements can be laid down upon marking material that has been applied to a pavement surface at a substantially reduced relative velocity in the direction of extension of the pavement. Preferably the optical elements can be ejected at a component velocity that is substantially the same velocity that the vehicle is moving forward but in the opposite direction so that the relative velocity in the direction of extension of the pavement between the optical elements and the pavement marking material on a road surface is zero. That is, the movement of the optical elements in the direction parallel to the pavement surface rearward (regardless of the component of movement toward the pavement) is preferably equal to the velocity of the vehicle moving forward. By more closely matching the optical element velocity (in a direction opposite the vehicle movement) to the velocity of the vehicle, the optical elements can be laid down without substantial roll along the pavement marking material as applied to a roadway.

This can be accomplished regardless of the size or mass of the optical elements. The result is that the retroreflectivity of the pavement marking is not compromised or negatively affected in either direction (i.e. in the direction of vehicle travel or in the opposite direction). Moreover, the optical elements can be deposited onto the pavement marking material at whatever density is desired to achieve the desired retroreflective characteristic of the pavement marking. This density of application is determined independently of the velocity control caused by the fluid assist. It is also preferable that the dispensing nozzle include a diverging guide surface and have the capability to adjustably control the distribution width so that the optical elements can be applied at a desired width relative to the width of the pavement marking material.

The aforementioned advantages of the present invention are achieved by a particle dispensing device that is to be mounted to a vehicle for use in dispensing optical elements while the vehicle is moving onto pavement marking material that has been applied to a surface as part of a pavement marking process, where the particle dispensing device includes a nozzle, a feed tube and a fluid assist system. The term "fluid" as used within the meaning of "fluid assist system" and throughout this application is meant to include liquids and/or gases that are usable as a pressurized source (although not necessarily compressible) and that may be used to propel particles, such as optical elements, in accordance with the present invention. Gases are preferably used because they would not mix within the dispensed particle stream and be applied to the pavement marking material. Air is most preferably used for this purpose.

The nozzle defines an expansion chamber and preferably has a bottom guide plate and a top plate spaced from the bottom guide plate by at least one side wall, the side wall, bottom guide plate providing a guide surface and the top plate to form the expansion chamber with an open side. The bottom guide plate also preferably extends beyond the open side of the expansion chamber to guide particles along the nozzle as they are ejected from the expansion chamber. The particle feed tube is for connection with an optical element supply and connection with the nozzle, the particle feed tube also including an internal passage that opens into the expansion chamber. The fluid assist system comprises an orifice defining element for connection to a pressurized fluid source, the orifice defining element also being operatively connected to the nozzle and positioned to permit fluid under pressure to flow through an orifice thereof and to be injected into the expansion chamber so as to generate the velocity of the particles in the opposite direction of the moving vehicle to which this dispenser is attached. Preferably, the fluid is also injected into the expansion chamber so as to uniformly distribute the particles for dispensing them from the nozzle. Moreover, the guide surface of the bottom guide plate is oriented at least partially horizontally. Most preferably, the guide surface of the bottom guide plate is oriented at approximately 5 degrees to 10 degrees below a horizontal plane (i.e. with the distal end thereof lower than the expansion chamber. The exit particle velocity in the opposite direction of vehicle travel is thus greater than it would be if the particles were to exit under the force of gravity alone.

Preferably, the fluid assist system further comprises a fluid pressure supply line connected to the orifice defining element and connectable to a pressurized fluid source and the orifice defining element includes an internal chamber that has a larger open area in transverse cross section than the orifice thereof, the internal chamber also being open from a side thereof that is connected to the fluid pressure supply line. A surface feature can also be provided at a side of the orifice defining element that is positioned within the expansion chamber, and which surface feature modifies the fluid flow from the orifice into the expansion chamber. The particle dispensing device may also include at least one adjustable side guide element that also extends in the direction of the bottom guide plate from the expansion chamber so as to laterally limit the flow of particles from the nozzle and to guide the particles from the nozzle. The bottom guide plate also preferably diverges from the opening of the expansion chamber.

The aforementioned advantages of the present invention are also achieved by a method for dispensing optical elements onto pavement marking material that has been applied to a pavement surface as part of a pavement marking process from a particle dispensing system of the type having an optical element supply container, a pressurized fluid source and a particle dispensing device that are supported on a movable vehicle, the particle dispensing device including a nozzle having an expansion chamber. Preferably, the expansion chamber is bounded at least in part by top and bottom guide plates that are spaced from one another by at least one side wall and having an open side, the nozzle further being connected to the optical element supply container by way of a feed tube that opens into the expansion chamber of the nozzle and being connected to the pressurized fluid source by way of a fluid assist system having an orifice that also opens into the expansion chamber. A method in accordance with the present invention is characterized by including the steps of orienting the dispensing device so that the guide surface of the bottom guide plate of the nozzle is at least partially extended in the direction of extension of the pavement surface to which optical elements are to be applied; feeding optical elements to the expansion chamber of the nozzle while the vehicle is moving; and supplying pressurized fluid through the orifice of the fluid assist system and into the expansion chamber of the nozzle while optical elements are also fed into the expansion chamber and thereby generating a controlled component velocity of the particle flow from the nozzle in the opposite direction of the direction of vehicle velocity to which this dispenser is attached.

A method in accordance with the present invention is also preferably characterized by conducting the orienting step so as to orient the open side of the expansion chamber in a direction opposite to the direction of vehicle travel and to orient the nozzle so that its bottom guide plate extends moreso in the direction of extension of the pavement surface to which optical elements are to be applied than in a direction directly toward the pavement surface to which optical elements are applied. The step of feeding optical elements can be done under pressure to thereby urge the optical elements toward the expansion chamber. Preferably, the step of supplying pressurized fluid further comprises supplying pressurized air, which air pressure can be independently controlled so that the air pressure and air flow through the orifice into the expansion chamber ejects the optical elements from the nozzle at an exit velocity that is based upon a desired relative velocity of the optical elements to the surface of the pavement to which the optical elements are to be applied. Most preferably, this step comprises substantially matching a component of the particle exit velocity in the rearward direction of vehicle movement (i.e. the direction of extension of the surface of the pavement to which the optical elements are to be applied) with the velocity of the vehicle and thereby substantially causing a zero relative velocity between the optical elements and the surface of the pavement in the direction of its extension. The method may also comprise a step of laterally guiding the optical elements from the expansion chamber of the nozzle by at least one adjustable side guide element that is operatively supported and positionable at multiple locations with respect to a diverging side edge of the bottom guide plate. Moreover the method is preferably utilized with the additional step of applying the optical elements in accordance with a desired optical element density onto pavement marking material that has been previously applied to a pavement surface as part of a pavement marking process while it is capable of at least permitting optical elements to embed within the marking material.

BRIEF DESCRIPTION OF THE DRAWINGS

FIG. 8 shows a sample where the composite retroreflective elements were applied by a method in accordance with the present invention.

DETAILED DESCRIPTION OF THE PREFERRED EMBODIMENTS

Figure 1:
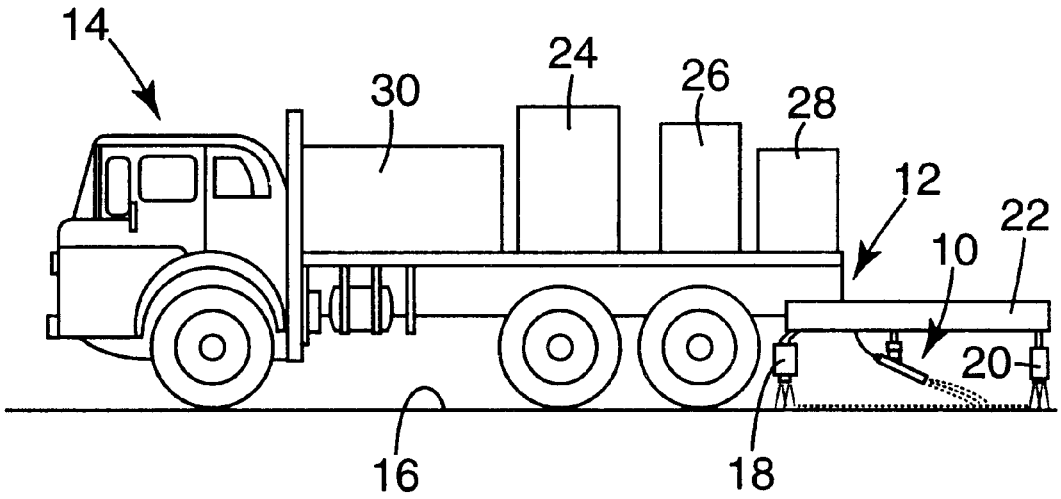
FIG. 1 is a side view of a motor vehicle combined with a schematic illustration of a pavement marking apparatus including an optical element dispenser in accordance with the present invention.

With reference to the Figures, wherein like components are labeled with like numerals throughout the several Figures, a particle dispenser 10 is illustrated in FIG. 1 as part of a pavement marking dispensing apparatus 12 that is mounted to a vehicle 14. The pavement marking dispensing apparatus 12, including the particle dispenser 10, are provided in particular for applying pavement marking to a road surface 16 while the vehicle 14 is moving. The vehicle 14 may comprise a motorized vehicle, such as a truck, as illustrated in FIG. 1. However, any moveable vehicle is contemplated including those that are propelled by a motor or by manual operation. Moreover, the vehicle 14 may comprise a hand operated unit, whether motor drive or not, such as are known for smaller pavement marking operations.

As discussed above in the Background section of the subject application, such a pavement marking dispensing apparatus typically includes means for applying a paint or resin to the road surface 16 in the form of a pavement marking with or prior to the application of optical elements to be embedded into the pavement marking material for retroreflectivity characteristics of the pavement marking. Many different types of paints and resins have been developed for use in the pavement marking industry, any of which are contemplated to be used in accordance with the present invention as described below. In particular, optical elements should be mixed with or laid down upon the pavement marking material prior to its drying or setting so that the optical elements are at least partially embedded therein or held thereby, or both. For example, where a paint spray nozzle is utilized, optical elements are deposited prior to the paint drying. Where a thermoplastic resin is applied by a conventionally known spray or extrusion device, the optical elements are laid down while the thermoplastic resin is still heated (or has been reheated) sufficiently prior to setting. Where an epoxy resin is sprayed or extruded onto pavement, the optical elements are laid down prior to the epoxy curing.

As also set out in the Background section of the subject application, optical elements can include any elements that provide retroreflectivity when applied to the pavement marking material including, for example, glass beads and/or composite retroreflective elements that themselves comprise an aggregate of a core with any number of smaller optical elements embedded at the core surface or within the core material (which itself may be transparent).

The pavement marking dispensing apparatus 12 may comprise any combination of a particle dispenser 10 in accordance with the present invention combined with any paint spray or resin spray or extruder known or developed for pavement marking. Moreover, the particle dispenser 10 of the present invention may dispense any type of optical particle or the like which is to be dispensed onto such pavement marking material after it is dispensed on the surface of a roadway 16. The following description is directed to one specific version in accordance with the present invention where a particle dispenser 10 is utilized for dispensing composite retroreflective optical elements in combination with the dispensing of a paint or resin and the dispensing of glass beads as additional retroreflective elements of a resultant pavement marking.

As shown in FIG. 1, a vehicle 14 is combined with a pavement marking dispensing apparatus 12. The manner of connection between them does not forma specific part of the present invention and may comprise any conventional or later-developed structure. The pavement marking dispensing apparatus 12 is illustrated mounted to the vehicle 14 so as to be positioned for the purpose of providing a pavement marking to a surface of a roadway 16 in a direction of travel of the vehicle 14 over the roadway 16. Typically, such an apparatus is useable for roadway striping.

The pavement marking dispensing apparatus 12 comprises, in the order of application to the roadway 16, a paint or resin applicator 18, a particle dispenser 10 for dispensing composite retroreflective elements, and a bead dispenser 20, though either of the latter two could be used alone. The applicator 18, particle dispenser 10 and bead dispenser 20 are illustrated supported by a common support structure 22, but it is understood that these devices may otherwise be supported in any way independently or in combination with one another. Preferably, however, these devices are relatively positioned so that the composite retroreflective elements are laid down upon the pavement marking material prior to the application of the glass beads.

Also illustrated in FIG. 1 as supported by the vehicle 14 are a pavement marking material supply container(s) 24, a composite retroreflective element supply container 26, and a glass bead supply container 28. These supply containers 24, 26 and 28 may be operatively fluidically connected with applicator 18, dispenser 10 and bead dispenser 20, respectively, by any conventional or later-developed way in accordance with the functional features described below, in particular with respect to the particle dispenser 10. Also illustrated supported on the vehicle 14 is a mechanical station 30 that may conventionally include fluid pressure generation means, such as an air compressor or the like, and whatever control systems are desired for controlling the operation of the applicator 18, dispenser 10 and dispenser 20 in accordance with conventional usage and the operation of the present invention described below. Furthermore, the specific construction and control mechanisms of the applicator 18 for applying the pavement marking material and the bead dispenser 20 for applying transparent microspheres can be any conventional or later-developed construction.

Figure 2:
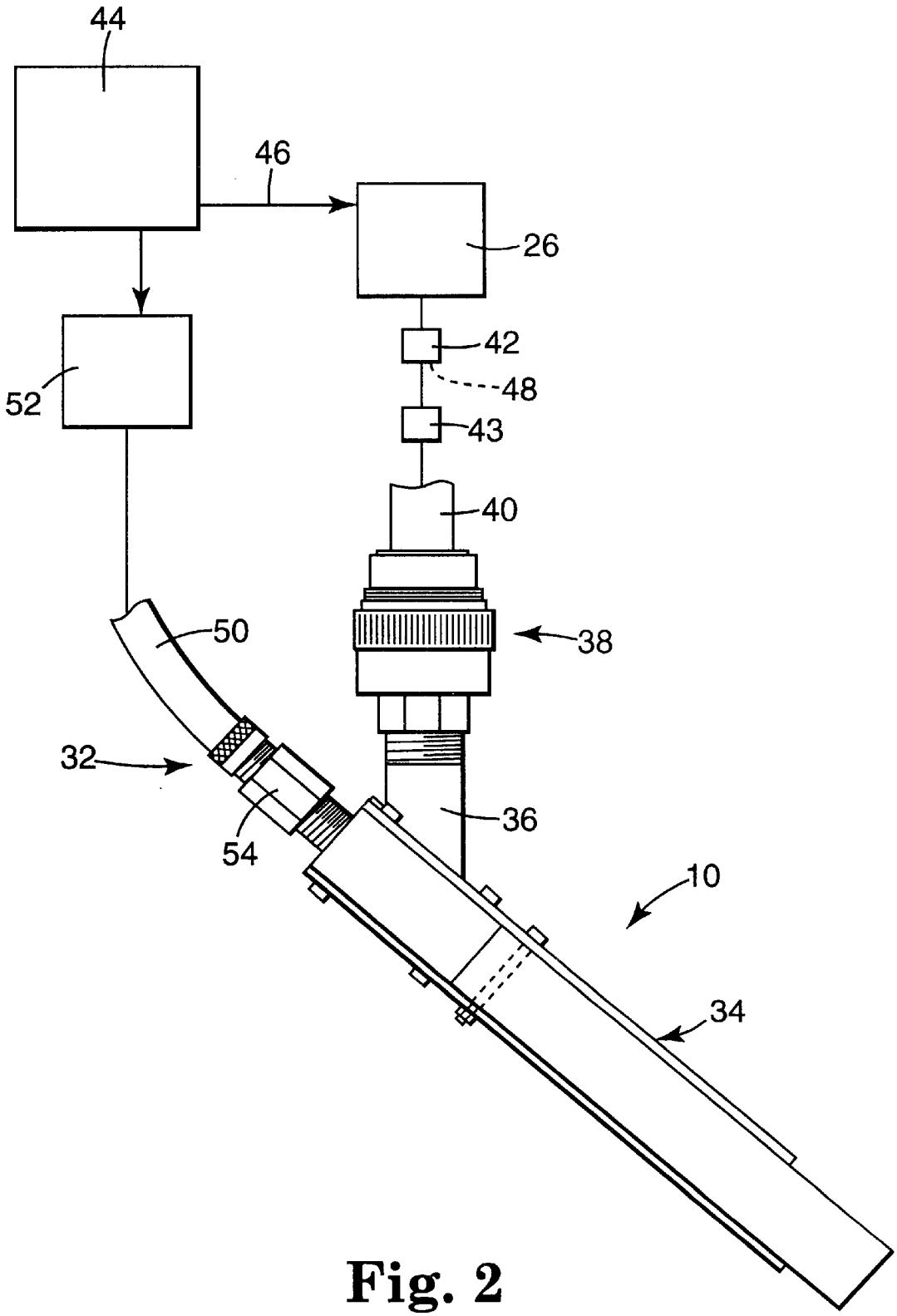
FIG. 2 is a side view of a dispenser in accordance with the present invention schematically provided as part of a dispensing system for applying optical elements to pavement marking material.
Figure 3:
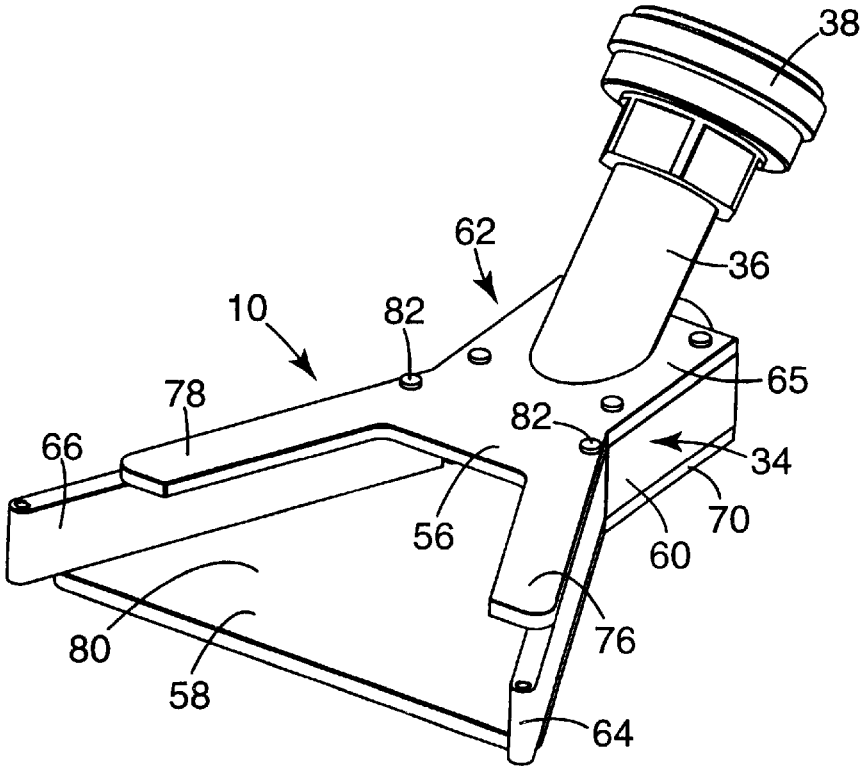
FIG. 3 is a perspective view of a dispenser in accordance with the present invention.

In FIG. 2, the particle dispenser 10 is illustrated schematically connected with the supply container(s) 26 and to a fluid assist system 32. In particular, the particle dispenser 10 includes a nozzle 34 and a feed tube 36. The feed tube 36 is provided so that composite retroreflective elements from supply container 26 can be fed to the nozzle 34. As illustrated, the feed tube 36 is connected via a conventional-type connector assembly 38 to a supply line 40, which in turn runs to the supply container 26. Preferably, a pressure control reservoir 42 and a metering device 43, such as a gun, are included in the supply line 40 between the supply container 26 and the feed tube 36, most preferably at a point near the feed tube 36. The metering device 43 controls the delivery of a specific rate and quantity of the composite retroreflective elements. The supply container 26 is also preferably pressurized so that composite retroreflective elements contained therein can be pressure fed to the pressure controlled reservoir 42, metered through the device 43, and fed through supply line 40 and feed tube 36 to the nozzle 34. To do this, the supply container 26 is schematically illustrated as receiving pressurized fluid, preferably air from a fluid pressure source 44 via a pressure line 46. The fluid pressure supplied to the container 26 via line 46 can be controlled in any way so that a desired pressure can be maintained within the container 26 for urging the composite retroreflective elements therein toward the reservoir 42. The pressure control reservoir 42 is preferably provided in order to maintain the desired air pressure while allowing a sufficient volume of fluid to flow through the metering device 43 so that the pressurized fluid volume effectively moves the composite retroreflective elements to the nozzle 34 via the feed tube 36. The pressure control reservoir 42 preferably bleeds most of the air volume through it as indicated by the dashed line 48 to aid the metering process by device 43. Typically, the fluid pressure would be maintained at about 2–5 psi within the supply line 40. Preferably, the element supply container 26 is kept at low pressure (2–5 psi) to allow the element supply to bypass reservoir 42 and feed the metering device 43, which in turn feeds to nozzle 34.

The fluid assist system 32 comprises an operative fluid source, preferably a gas, for assisting movement of composite retroreflective elements through and from the nozzle 34 and comprises a fluid supply line 50 connected to a fluid pressure source, which as illustrated, comprises the same fluid pressure source 44 utilized in providing fluid pressure to the supply container 26. Of course, a separate fluid supply of a same or different type of fluid than that utilized in the supply container 26 can be used instead. Any fluid, whether liquid of gas, is contemplated to be usable in accordance with the present invention so long as it can be supplied under a pressure (although not necessarily compressible) so as to propel particles, such as optical elements, from the nozzle 34 in accordance with the present invention. Gases are preferably used because they would not mix within the dispensed particle stream and be applied to the pavement marking material. Air that is supplied from a pressurized air source is most preferably used for this purpose. In fluid supply line 50, a control valve mechanism 52 is also preferably provided, the purpose of which is to regulate the fluid pressure that is supplied through line 50 via a conventional fitting 54 to the nozzle 34.

Moreover, the valve control mechanism 52 preferably includes or is part of a control system by which the fluid pressure within supply line 50 can be modified either as part of an automatic system or a manually adjustable system so that the fluid supply to the nozzle 34 as part of the assist feature can be regulated to generate a desire movement of composite retroreflective elements through the nozzle 34. Preferably, the fluid pressure in line 50 is in the range of 3–10 psi for dispensing composite retroreflective elements, as described above. It is contemplated that a control system can automatically regulate the fluid pressure of the fluid assist system 32 based upon the vehicle velocity, the characteristics of the particle dispensed, and any number of other fluid dynamic or particle related characteristics to achieve the functionality of the present invention. Such a control system can include an input device whereby an operator provides information related to the criteria of the particles and/or usage and/or any number of sensors that may be useful in determining the proper pressure to attain results desirable in accordance with the present invention. That is, the pressure may be adjusted to cause optical elements or other particles to be ejected from nozzle 34 at a velocity sufficient to attain the benefits of the present invention. It is contemplated that such a control system may also include a feed back type system so that adjustments in pressure or feed rate can be made while a vehicle is moving and optical elements are being dispensed. Environmental or conditional changes may be appropriately sensed, for example, road conditions, road terrain, vehicle velocity, and the like for automatic adjustment of the optical element deposition. The control system may also be operatively connected with any known or later-developed marking sensor system to apply new markings directly over old markings as they are sensed.

It is also noted in FIG. 2 that the nozzle 34 is illustrated oriented at an angle $\alpha$. In this regard, it is preferable that the nozzle angle $\alpha$ provide a greater component of movement of particles from nozzle 34 in a direction parallel to the surface of a roadway 16 as compared to a component of movement directly toward the roadway 16. For a road that is considered to be horizontal, that means particles that move more horizontally than they do vertically toward the road. The velocity that the particles exit from the nozzle 34 is preferably chosen so that this parallel or horizontal component substantially matches the velocity at which the vehicle is moving forward while the nozzle is oriented to eject the particles rearward. By matching the rearward particle velocity to the forward vehicle motion, particles, such as composite retroreflective elements, can be laid down upon any pavement marking materially with substantially no relative velocity along the direction of extension of the pavement. A zero relative velocity is preferred, but is not necessary. It is desired minimally that the particles be laid onto the pavement marking material in a way to at least reduce and preferably minimize particle rolling on the pavement marking material.

A preferred construction of the particle dispenser 10 is illustrated in FIGS. 3–6. Specifically, a portion of the particle dispenser 10 is the nozzle 34, which preferably comprises a top plate 56, a bottom guide plate 58, fixed side pieces 60 and 62 and articulated guide elements 64 and 66. The bottom guide plate 58 is utilized to provide a guide surface over which the optical elements are to be transferred and for directing the flow of the optical elements for exiting the nozzle 34. A first portion 68 of the top plate 56 is preferably similarly shaped as a first portion 70 of the bottom guide plate 58 so that they can be connected together by the side pieces 60 and 62 so as to define an expansion chamber 72 (see FIG. 6) between the first portions 68 and 70 of the top and bottom guide plates 56 and 58, respectively. The manner of defining an expansion chamber 72 is not critical, but it is preferred that the expansion chamber 72 provide an internal chamber to accommodate mixing of the fluid from the fluid assist system 32 and optical elements from the feed tube 36 as noted below. The expansion chamber 72 can be provided by more or less elements than in the described embodiment and may be otherwise configured in any different shape to provide desired fluid flow characteristics. The expansion chamber 72 also should be open to at least one side so that the optical elements can be expelled therefrom and over the guide surface, such as provided by the bottom guide plate 58.

The feed tube 36 is preferably fixed to the first portion 68 of the top plate 56 in a position so that its internal passage 74 opens into the expansion chamber 72. That way, particles, such as composite retroreflective elements, are fed as described above through the feed tube 36 and into the expansion chamber 72 of the nozzle 34. The feed tube 36 may be integrally made with the top plate 56 or they may be made separately and attached thereto in either a permanent way such as welding, or in a removable way if desired. As also illustrated in the Figures, the feed tube 36 is preferably connected to the top plate 56 so that it is at an angle to the nozzle 34 to facilitate mounting and orientation of the nozzle at a desired angle. It is noted that the feed tube 36 need not be oriented at the same angle $\alpha$ for dispensing, and that the feed tube 36 need not be vertically oriented as the dispenser 10 is properly oriented by means of its mechanical mounting at a desired angle $\alpha$ for dispensing.

The upper plate 56 also preferably comprises a pair of extension portions 76 and 78 that extend away from the connection with the feed tube 36 to assist in guiding particles from the nozzle 34. Bottom guide plate 58 comprises a second portion 80 that extends in the same direction from the first portion 70 of the bottom guide plate 58 and provides a lower guide surface over which particles can travel as they are dispensed. Second portion 80 of the bottom guide plate 58 preferably provides a diverging surface that may be extended further and/or otherwise modified so as to guide the particles toward the desired location on a roadway. The upper plate 56 preferably instead comprises the extension portions 76 and 78 so as to leave an open zone above the second portion 80 of bottom guide plate 58 to facilitate the flow of particles through the nozzle 34 with less resistance and thus a reduced tendency for the particles to clog the nozzle 34.

The articulated guide elements 64 and 66 are preferably articulated between the top and bottom guide plates 56 and 58, such as by a pivotal mounting that may include conventional pivot pins 82 that are connected through the width of the articulated guide elements 64 and 66 and the top and bottom guide plates 56 and 58, respectively. By articulating the guide elements 64 and 66 at their inner ends at a point on nozzle 34 near the formation of the expansion chamber 72, particles can be guided along the second portion 80 of the bottom guide plate 58 as limited by the positions of the articulated guide elements 64 and 66. That is, the width of the spray pattern of particles from the nozzle 34 can be regulated by moving the articulated guide elements 64 and 66 over the surface of the second portion 80 of the bottom guide plate 58. Either articulated guide element 64 or 66 can be moved independently of the other, and they may be held in position simply by friction or they may be locked or otherwise set in selected positions by any conventional mechanism, such as a series of detents. Preferably, the articulated guide elements 64 and 66 can be positioned in multiple positions including at least a position along a diverging side edge of the second portion 80 of the bottom guide plate 58.

Figure 4:
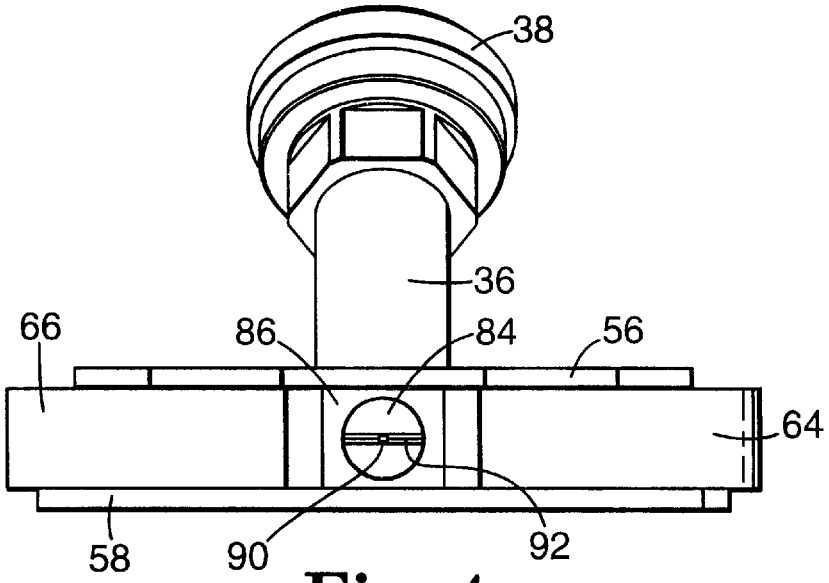
FIG. 4 is a front view of the dispenser of FIG. 3 showing the entry point of the fluid assist into the nozzle portion of the dispenser.
Figure 5:
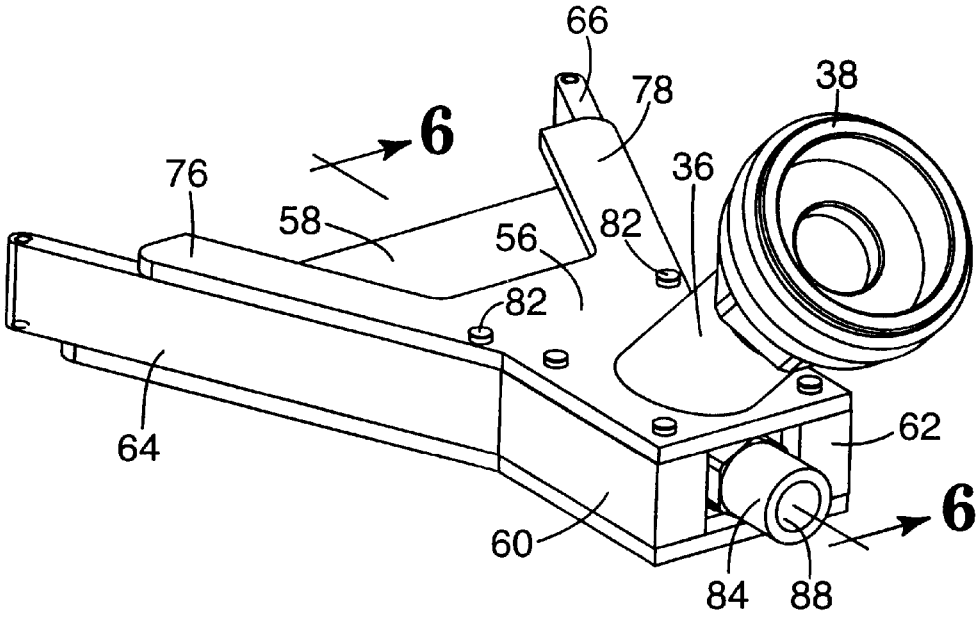
FIG. 5 is a perspective view from the backside of the dispenser of FIGS. 3 and 4.
Figure 6:
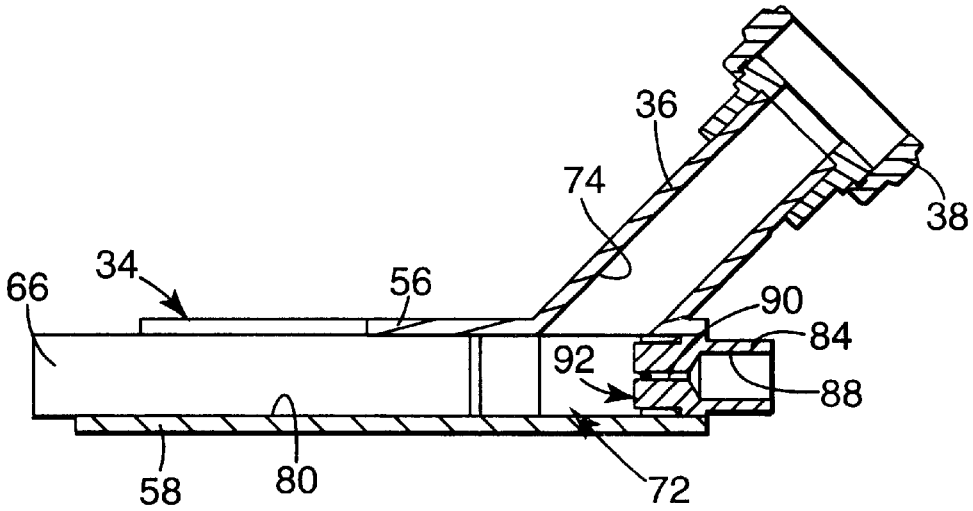
FIG. 6 is a cross sectional view taken along line 6—6 in FIG. 5 showing the relative connections of the passages of the feed tube and the fluid assist orifice into the nozzle portion of the dispenser of FIGS. 3–5.

As shown in FIGS. 4 and 6, the fluid assist system is connected to the nozzle 34 via a fluid orifice defining element 84 that is secured in position through a rear chamber wall 86 connected between the fixed side pieces 60 and 62 and between the first portions 68 and 70 of the top and bottom guide plates 56 and 58, respectively. Any connection means, such as a threaded connection can be utilized for holding the fluid orifice defining element 84 in place. Moreover, any means for securing any and all of the nozzle forming parts together may be utilized, including the use of permanent connection, such as welds, or conventional removable fasteners, such as nuts and bolts or machine screws.

The fluid orifice defining element 84 is provided with a first internal passageway that extends within the fluid orifice defining element 84 partway from an open end positioned adjacent to the fitting 54 for connection thereof with the fluid supply line 50. An orifice 90 that is preferably centrally located, provides fluid communication from the first internal passageway 88 into the expansion chamber 72 of the nozzle 34. The size of the orifice 90 can be selected based upon the desired fluid flow through it into the expansion chamber 72. As illustrated in FIG. 4, the orifice 90 can open into a fan shaped slot 92 provided from the inside surface face of the fluid orifice defining element 84. Such a fan shaped slot 92 facilitates fluid flow from the orifice 90 to assist in particle distribution along the articulated guide elements 64 and 66 from the expansion chamber 72. It is contemplated that the orifice 90 itself may comprise any shape and/or any number of such orifices can be provided through the fluid defining orifice element 84. Moreover, other surface variations than the fan shaped slot 92 can be incorporated, again depending on the desired effect in distributing particles from the nozzle 34. The orifice defining element 84 itself is preferably removable so that any of multiple different orifices can be substituted as desired for any particular application.

As above, the particle dispenser 10 is designed specifically for dispensing optical elements, such as composite retroreflective elements onto pavement marking material while it is possible for the particles to be embedded or held by the pavement marking material in position. Moreover, it is desirable in accordance with one aspect of the present invention to dispense such optical elements onto the pavement marking material in a way to minimize rolling of the particles within the pavement marking material, which as discussed in the Background section above, can have a deleterious effect on the retroreflective ability of the pavement marking in a direction of the dispensing vehicle movement. That is, the particles would tend to roll in the direction of vehicle movement if not for the fluid assist system of the present invention. The purpose of an independent fluid assist system is to cause the particles to be ejected from the nozzle 34 rearwardly at a component velocity in the component direction of the roadway that is greater than they if the particles were to exit the nozzle only under the force of gravity (which rearward movement may result from being deflected that way). Preferably, the rearward velocity is substantially similar to the vehicle velocity going forward. Then, the particles can be deposited at zero relative velocity to the pavement in the direction of pavement extension to minimize or eliminate roll.

By the construction of the particle dispenser 10 of the present invention, one embodiment of which is specifically describe above, the fluid assist feature is independent of the particle supply. That is, particles are supplied under pressure from a supply container 26 through a supply line 40 and via the feed tube 36 into the expansion chamber 72. Since the internal passage 74 of the feed tube 36 opens into the larger volume of the expansion chamber 72, the particle flow and thus its feed rate are defined prior to the particles entering the expansion chamber 72.

The orifice 90 passes fluid of the fluid assist system into the expansion chamber 72 so as to facilitate speeding up of particle flow from the nozzle 34 over the portion 80 of the lower plate 56 thereof independently of the feed rate by which particles are supplied into the expansion chamber 72. Moreover, both the feed rate of particles and the pressure of the fluid of the fluid assist system are independently controllable so as to provide maximum flexibility in dispensing a desired density of optical elements onto pavement marking material and at a desired velocity to minimize or eliminate optical element rolling on the pavement marking material.

Moreover, it is believed that the increased velocity at which the optical elements leave the nozzle 34 also enhances the anchorage of the optical elements within the pavement marking material. That is, the fluid assist also generates a somewhat higher component velocity in the direction toward the pavement marking material. This causes the particles to strike the pavement marking material with additional force, which is beneficial in embedding the optical elements within the pavement marking material.

The characteristics of the fluid flow provided from the fluid assist system 32 (i.e. the volume of the fluid flow and the pressure thereof) can be varied in order to optimize the degree of the fluid assist that results in minimized rolling. That is, the degree of help provided by the fluid assist system 32 can be determined by trial and error for a given optical element feed rate and vehicle velocity. Such information can otherwise be developed empirically or may be estimated by theoretical calculations. In any case, this data may be maintained and/or stored, such as in computer memory, so that for given particles and dispensing characteristics, the air pressure and flow rate into the expansion chamber 72 can be controlled via a valve control mechanism 52 and/or the orifice 90 in accordance with such known data.

The amount of rolling of such optical elements can be determined by measuring the retroreflectivity in both the direction of movement of the vehicle and the opposite direction, and then comparing them to one another. The larger the difference, the more rolling that is indicated. Retroreflectivity can be measured per "Standard Test Method for Measurement of Retroreflective Pavement Marking Materials with CEN-prescribed Geometry using a Portable Retroreflectometer," ASTME 1710.

Table 1 is provided below with data obtained representing reflectivity measured in the vehicle movement direction and against that direction. The number on the left side of the table represents a pavement marking. As these numbers increase, so did the air provided by the air assist increase. The other columns indicate the readings that were made and the mean values for selected groups of readings in both directions. Comparing the mean values provides an average difference between the retroreflective nature in both directions.

TABLE 1

| | Reading #1 | Mean | Against traffic | Mean | Difference between with vs. against Traffic | |
|---|---|---|---|---|---|---|
| 1 | 776 | | 1336 | | (Bigger difference means more rolling) | The reflectivity difference get smaller as rolling is minimized by adjusting air to accelerate the velocity of the elements to match the velocity of the truck. Increase fluid flow or pressure to increase element velocity. ↓ Negative difference means that the pressure was over-adjusted causing the elements to roll in the direction opposite the truck movement. |
| 4 | 1028 | | 1327 | | | |
| 8 | 917 | | 1357 | | | |
| 12 | 1272 | | 1588 | | | |
| 16 | 1385 | | 1464 | | | |
| 20 | 1114 | | 1460 | | | |
| 24 | 1079 | | 1264 | | | |
| 28 | 1258 | | 1230 | | | |
| 32 | 1355 | | 1229 | | | |
| 36 | 1123 | | 1515 | | | |
| 40 | 1350 | 1150.6 | 1658 | 1402.5 | 251.9 | |
| 44 | 342 | | 551 | | | |
| 48 | 1125 | | 1315 | | | |
| 52 | 1070 | | 1421 | | | |
| 56 | 1253 | | 1452 | | | |
| 60 | 1313 | | 1600 | | | |
| 64 | 1272 | | 1158 | | | |
| 68 | 1158 | | 1516 | | | |
| 72 | 1016 | | 1309 | | | |
| 76 | 984 | | 1360 | | | |
| 80 | 1448 | 1098.1 | 1503 | 1318.5 | 220.4 | |
| 84 | 402 | | 477 | | | |
| 88 | 686 | | 729 | | | |
| 92 | 576 | | 779 | | | |
| 96 | 537 | | 640 | | | |
| 100 | 552 | | 634 | | | |
| 104 | 532 | | 626 | | | |
| 108 | 682 | | 660 | | | |
| 112 | 577 | | 658 | | | |
| 116 | 563 | | 694 | | | |

TABLE 1-continued

| | Reading #1 | Mean | Against traffic | Mean | Difference between with vs. against Traffic |
|---|---|---|---|---|---|
| 120 | 547 | 565.4 | 680 | 657.7 | 92.3 |
| 124 | 588 | | 581 | | |
| 128 | 1163 | | 1004 | | |
| 132 | 1213 | | 942 | | |
| 136 | 1494 | | 1746 | | |
| 140 | 1538 | | — | | |
| 144 | 1493 | | 1569 | | |
| 148 | 1351 | | 982 | | |
| 152 | 886 | | 935 | | |
| 156 | 1287 | | 772 | | |
| 160 | 634 | 1164.7 | — | 1066.4 | −98.3 |

As illustrated in Table 1, by increasing the fluid assist air pressure, the rolling is reduced. Moreover, opposite roll can be induced as evidenced by a negative difference. A negative difference generally is of less importance, since there is less concern with retroreflectivity against the traffic direction. No matter whether the difference is negative or positive, the increased pressure also advantageously helps anchorage of the elements and beads into the pavement marking material that acts as a binder.

Figure 7:
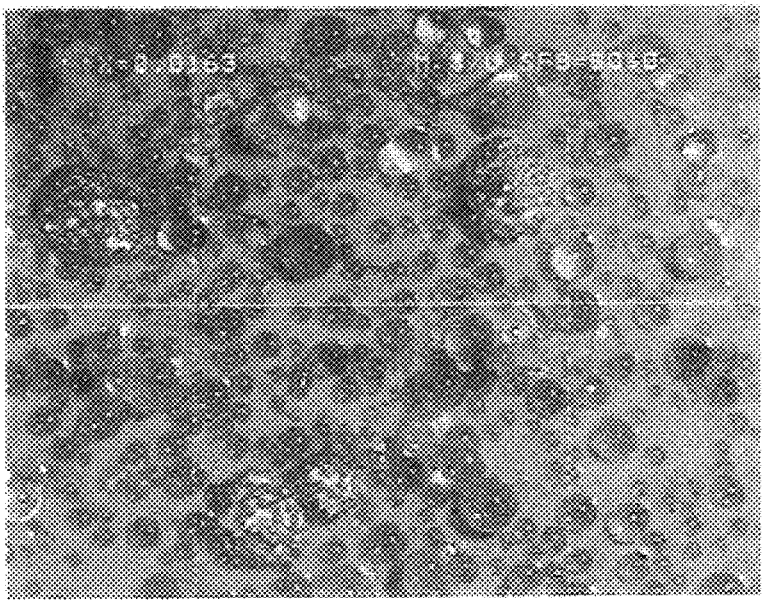
FIGS. 7, 8 and 9 are enlarged photographic images showing samples of pavement marking materials applied to a substrate, the pavement marking materials in each case including a combination of composite retroreflective elements and glass beads that have been applied under different circumstances for comparison. In particular.
Figure 8:
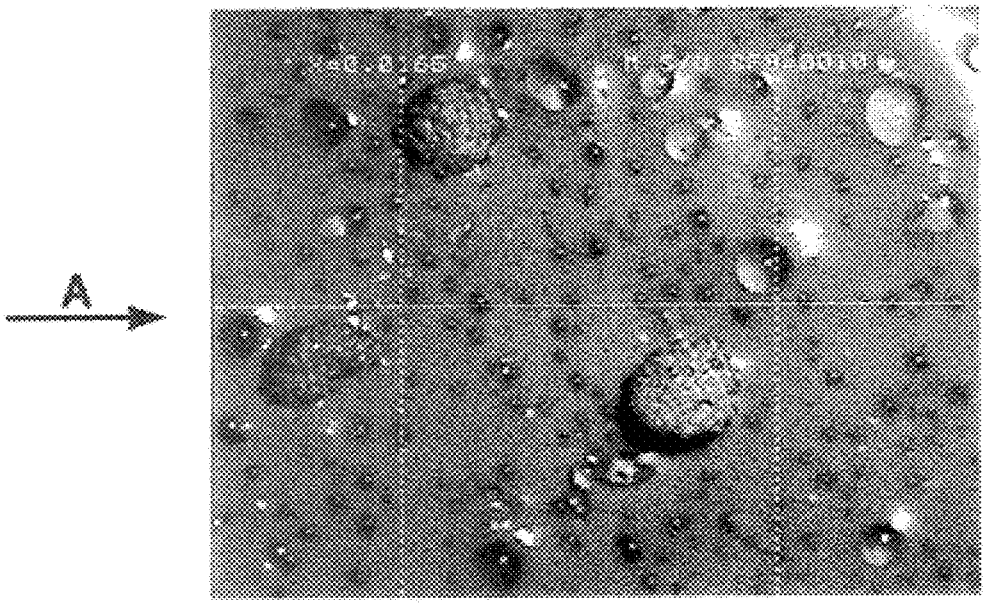
Figure 9:
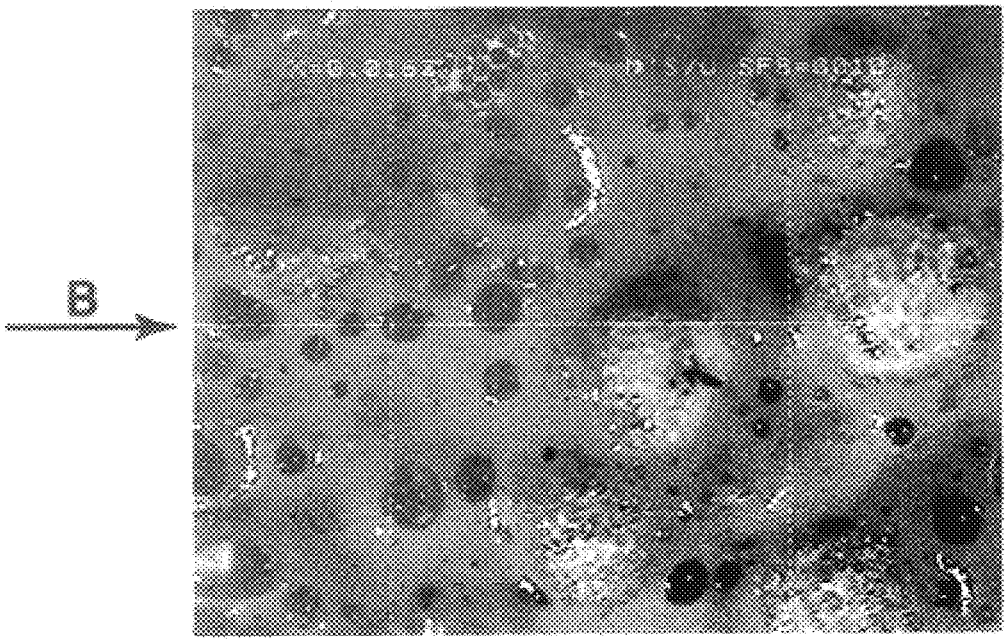

FIGS. 7, 8 and 9 are enlarged photographic images showing samples of pavement marking materials applied to a substrate, the pavement marking materials in each case including a combination of composite retroreflective elements and glass beads that have been applied under different circumstances. In FIG. 7, a laboratory prepared sample is shown with composite retroreflective elements and beads positioned on the pavement marking material, which acts as a binder. These elements and beads were dropped onto the pavement marking material, and as can be seen, they sink lightly into the binder material. That is, the elements and beads sit up high with no significant socket formed around the elements and beads for anchorage.

In FIG. 8, a sample is shown including composite retroreflective elements that were applied using an air assisted element applicator applied by a vehicle in the direction of arrow A and in accordance with the present invention. As can be seen, the elements sink in approximately half-way into the pavement marking material, forming sockets around the elements to provide good anchorage. This enhanced anchorage is expected to lead to better long-term element adhesion. Moreover, the elements do not exhibit any significant roll, i.e. they do not show pavement marking material covering their retroreflective surfaces.

In FIG. 9, a sample is shown including composite retroreflective elements that were applied by way of a conventional bead applicator of the type for deflecting the elements rearwardly without a fluid assist feature. The elements can be seen to have picked up pavement marking material. In addition, the elements clearly indicate the direction of roll as being the same as the direction of vehicle travel, which was in the direction of arrow B. Retroreflectivity is thus affected in the direction of vehicle movement based on the degree of this roll.

Also in accordance with an aspect of the present invention, the dispensing device 10 may be utilized to dispense particles, such as optical elements, with a purposeful roll. Specifically, by utilizing the same principles discussed above, one may desire to cause the optical elements to roll a specific amount, the result of which is a different retroreflectivity in one direction versus the opposite direction. For example, it may be desirable to have greater retroreflectivity against the direction of the applying vehicle, or vice versa. Where roll is desired in the vehicle direction, the optical elements may be ejected in the opposite direction slower than the vehicle velocity. Where roll is desired in the opposite direction of vehicle travel, the optical elements can be ejected with a greater velocity in that direction to cause roll. In any case, it is apparent that selective control of roll is possible, which amount of roll can be chosen based on a desired level of retroreflectivity.

Various modifications and alterations in accordance with the present invention will become apparent to those skilled in the art without departing from the scope and spirit of the present invention. It should further be understood that this invention is not to be limited by the illustrative embodiments described above.

What is claimed is:

1. A particle dispensing device to be mounted to a vehicle for use in dispensing and applying optical elements onto pavement marking material, that has been applied to a surface as part of a pavement marking process while the vehicle is moving, the, particle dispensing device comprising:

a nozzle having an expansion chamber with an open side and an application direction guide surface extending within at least a portion of the expansion chamber to guide and direct particles along at least a portion of the nozzle so that they can be ejected from the expansion chamber in an application direction to the pavement marking material as directed by the guide surface;

a particle feed tube for connection with an optical element supply and connected with the nozzle, the particle feed tube including an internal passage that opens into the expansion chamber by way of a first opening; and a fluid assist system comprising an orifice defining element for connection to a pressurized fluid source, the orifice defining element also being operatively connected to the nozzle and positioned to permit fluid under pressure to flow through an orifice thereof and to be injected into the expansion chamber by way of a second opening so that the fluid under pressure will create a fluid flow within the expansion chamber along the guide surface for causing a greater velocity of particle flow from the expansion chamber of the nozzle in the direction of the extension of the guide surface when it is oriented at least partially horizontally than would occur under gravity alone.

2. The particle dispensing device of claim 1, wherein the fluid assist system further comprises a fluid pressure supply line connected to the orifice defining element and connectable to a pressurized fluid source.

3. The particle dispensing device of claim 2, wherein the orifice defining element includes an internal chamber that has a larger open area in transverse cross section than the orifice thereof, the internal chamber also being open from a side thereof that is connected to the fluid pressure supply line.

4. The particle dispensing device of claim 3, wherein the orifice defining element further includes a surface feature at a side thereof that is positioned within the expansion chamber, and which surface feature modifies the fluid flow from the orifice into the expansion chamber.

5. The particle dispensing device of claim 1, wherein the nozzle further comprises a bottom guide plate and a top plate spaced from the bottom guide plate by at least one side wall, the side wall, bottom guide plate and the top plate forming the expansion chamber.

6. The particle dispensing device of claim 5, wherein the bottom guide plate extends beyond the open side of the expansion chamber and provides the guide surface for guiding particles along a portion of the nozzle as they are ejected from the expansion chamber.

7. The particle dispensing device of claim 6, further comprising at least one side guide element that also extends in the direction of the bottom guide plate from the expansion chamber so as to laterally limit the flow of particles from the nozzle and to guide the particles from the nozzle.

8. The particle dispensing device of claim 7, wherein the bottom guide plate diverges from the opening of the expansion chamber.

9. The particle dispensing device of claim 8, wherein the side guide element is adjustably connected to the nozzle so that it can be positioned at a first position substantially aligned with a diverging side edge of the bottom guide plate and at another position over a surface of the bottom guide plate.

10. A particle dispensing system to be supported on a movable vehicle and for dispensing optical elements onto pavement marking material, that has been applied to a surface as part of a pavement marking process while the vehicle is moving, the particle dispensing system comprising a pressurized fluid source and a particle dispensing device that comprises:

a nozzle having an expansion chamber with an open side and an application direction guide surface extending within at least a portion of the expansion chamber to guide and direct particles along at least a portion of the nozzle so that they can be ejected from the expansion chamber in an application direction to the pavement marking material as directed by the guide surface;

a particle feed tube connectable to an optical element supply container and connected with the nozzle, the particle feed tube including an internal passage that opens into the expansion chamber by way of a first opening; and a fluid assist system comprising an orifice defining element operatively connected to the pressurized fluid source, the orifice defining element also being operatively connected to the nozzle and positioned to permit fluid under pressure to flow through an orifice thereof and to be injected into the expansion chamber by way of a second opening so that the fluid under pressure will create a fluid flow within the expansion chamber along the guide surface for causing a greater velocity of particle flow from the expansion chamber of the nozzle in the direction of the extension of the guide surface when it is oriented at least partially horizontally than would occur under gravity alone.

11. The system of claim 10, wherein the pressurized fluid source comprises a pressurized air source.

12. The system of claim 11, further comprising a control system for controlling the air pressure within an air supply line that is connected to the orifice defining element.

13. The system of claim 10, further comprising an optical element supply container operatively connected with the particle feed tube by way of a particle supply line.

14. The system of claim 13, further comprising a pressurized feed means for urging optical elements from the optical element supply container toward the feed tube of the dispensing device.

15. The system of claim 12, wherein the orifice defining element includes an internal chamber that has a larger open area in transverse cross section than the orifice thereof, the internal chamber also being open from a side thereof that is connected to the fluid pressure supply line.

16. The system of claim 15, wherein the orifice defining element further includes a surface feature at a side thereof that is positioned within the expansion chamber, and which surface feature modifies the fluid flow from the orifice into the expansion chamber.

17. The system of claim 10, wherein the nozzle further comprises a bottom guide plate and a top plate spaced from the bottom guide plate by at least one side wall, the side wall, bottom guide plate and the top plate forming the expansion chamber.

18. The system of claim 17, wherein the bottom guide plate extends beyond the open side of the expansion chamber and provides the guide surface for guiding particles along a portion of the nozzle as they are ejected from the expansion chamber.

19. The system of claim 18, wherein the dispensing device further comprises at least one side guide element that also extends in the direction of the bottom guide plate from the expansion chamber so as to laterally limit the flow of particles from the nozzle and to guide the particles from the nozzle.

20. The system of claim 19, wherein the bottom guide plate diverges from the opening of the expansion chamber.

21. The system of claim 20, wherein the side guide element is adjustably connected to the nozzle so that it can be positioned at a first position substantially aligned with a diverging side edge of the bottom guide plate and at another position over a surface of the bottom guide plate.

22. The system of claim 14 in combination with a movable vehicle.

23. The combination of claim 22, wherein the movable vehicle comprises a motor driven vehicle.

24. A method of dispensing optical elements from a particle dispensing system having an optical element supply container and a pressurized fluid source that are supported on a movable vehicle onto pavement marking material that has been applied to a pavement surface as part of a pavement marking process, the method comprising the steps of:

providing a particle dispensing device that comprises a particle feed tube having an internal passage that opens into an expansion chamber of a nozzle, the expansion chamber having an open side, the nozzle having an application direction guide surface forming at least a part of the expansion chamber and for guiding and directing particles as they are ejected from the open side of the expansion chamber in an application direction to the pavement marking material as directed by the guide surface;

connecting the particle feed tube to the optical element supply container so that optical elements can be supplied to the expansion chamber of the nozzle; and connecting a fluid assist system to the nozzle by way of an orifice defining element that is operatively connected to the pressurized fluid source, the orifice defining element also being operatively connected to the nozzle and positioned to permit fluid under pressure to flow through an orifice thereof and to be injected into the expansion chamber so as to flow as directed by the guide surface;

orienting the dispensing device so that the guide surface of the nozzle is at least partially extended in the direction of extension of the pavement surface to which optical elements are to be applied;

feeding optical elements to the expansion chamber of the nozzle while the vehicle is moving; and supplying pressurized fluid through the orifice of the fluid assist system and into the expansion chamber of the nozzle while optical elements are also fed into the expansion chamber so that the pressurized fluid impinges the optical elements after being fed into the expansion chamber, the fluid flow along the guide surface causing a greater velocity of the particle flow from the nozzle in the direction of the extension of the guide surface of the nozzle than would occur under gravity alone.

25. The method of claim 24, wherein the orienting step further comprises orienting the open side of the expansion chamber in a direction opposite to the direction of vehicle travel.

26. The method of claim 25, wherein the orienting step further comprises orienting the nozzle so that its guide surface extends more so in the direction of extension of the pavement surface to which optical elements are to be applied than in a direction directly toward the pavement surface to which optical elements are applied.

27. The method of claim 24, wherein the step of feeding optical elements further comprises feeding the optical elements under pressure and thereby urging the optical elements toward the expansion chamber.

28. The method of claim 24, wherein the step of supplying pressurized fluid further comprises supplying pressurized air.

29. The method of claim 28, wherein the step of supplying pressurized air further comprises controlling the air pressure and air flow through the orifice into the expansion chamber and thereby ejecting the optical elements from the nozzle at an exit velocity that is based upon a desired relative velocity of the optical elements to the surface of the pavement to which the optical elements are to be applied.

30. The method of claim 29, wherein the step of ejecting the optical elements further comprises substantially matching a component of the particle exit velocity in the direction of extension of the surface of the pavement to which the optical elements are to be applied with the velocity of the vehicle and thereby substantially causing a zero relative velocity between the optical elements and the surface of the pavement in the direction of its extension.

31. The method of claim 24, further comprising a step of laterally guiding the optical elements from the expansion chamber of the nozzle by at least one adjustable side guide element that is operatively supported and positionable at multiple locations with respect to a diverging side edge of a bottom guide plate that provides the guide surface.

32. The method of claim 24, further comprising a step of applying the optical elements in accordance with a desired optical element density onto pavement marking material that has been previously applied to a pavement surface as part of a pavement marking process.

33. The method of claim 32, wherein the step of applying the optical elements comprises applying the optical elements while the previously applied pavement marking material is capable of permitting the optical elements to at least partially embed within the pavement marking material.

34. A method of dispensing optical elements onto pavement marking material that has been applied to a pavement surface as part of a pavement marking process from a particle dispensing system having an optical element supply container, a pressurized fluid source and a particle dispensing device that are supported on a movable vehicle, the particle dispensing device including a nozzle having an expansion chamber having an open side, the nozzle having an application direction guide surface forming at least a part of the expansion chamber and for guiding and directing particles as they are ejected from the open side of the expansion chamber in an application direction to the pavement marking material as directed by the guide surface, the nozzle further being connected to the optical element supply container by way of a feed tube that opens into the expansion chamber of the nozzle and being connected to the pressurized fluid source by way of a fluid assist system having an orifice that also opens into the expansion chamber to cause a fluid flow along the guide surface, the method comprising the steps of:

orienting the dispensing device so that the guide surface of the nozzle is at least partially extended in the direction of extension of the pavement surface to which optical elements are to be applied;

feeding optical elements to the expansion chamber of the nozzle while the vehicle is moving; and supplying pressurized fluid through the orifice of the fluid assist system and into the expansion chamber of the nozzle while optical elements are also fed into the expansion chamber so that the pressurized fluid impinges the optical elements after being fed into the expansion chamber, the fluid flow along the guide surface causing a greater velocity of the particle flow from the nozzle in the direction of the extension of the guide surface of the nozzle than would occur under gravity alone.

35. The method of claim 34, wherein the orienting step further comprises orienting the open side of the expansion chamber in a direction opposite to the direction of vehicle travel.

36. The method of claim 35, wherein the orienting step further comprises orienting the nozzle so that its guide surface extends more so in the direction of extension of the pavement surface to which optical elements are to be applied than in a direction directly toward the pavement surface to which optical elements are applied.

37. The method of claim 34, wherein the step of feeding optical elements further comprises feeding the optical elements under pressure and thereby urging the optical elements toward the expansion chamber.

38. The method of claim 34, wherein the step of supplying pressurized fluid further comprises supplying pressurized air.

39. The method of claim 38, wherein the step of supplying pressurized air further comprises controlling the air pressure and air flow through the orifice into the expansion chamber and thereby ejecting the optical elements from the nozzle at an exit velocity that is based upon a desired relative velocity of the optical elements to the surface of the pavement to which the optical elements are to be applied.

40. The method of claim 39, wherein the step of ejecting the optical elements further comprises substantially matching a component of the particle exit velocity in the direction of extension of the surface of the pavement to which the optical elements are to be applied with the velocity of the vehicle and thereby substantially causing a zero relative velocity between the optical elements and the surface of the pavement in the direction of its extension.

41. The method of claim 34, further comprising a step of laterally guiding the optical elements from the expansion chamber of the nozzle by at least one adjustable side guide element that is operatively supported and positionable at multiple locations with respect to a diverging side edge of a bottom guide plate that provides the guide surface.

42. The method of claim 34, further comprising a step of applying the optical elements in accordance with a desired optical element density onto pavement marking material that has been previously applied to a pavement surface as part of a pavement marking process.

43. The method of claim 42, wherein the step of applying the optical elements comprises applying the optical elements while the previously applied pavement marking material is capable of permitting the optical elements to at least partially embed within the pavement marking material.

* * * * *